United States Patent [19]

Rutherford et al.

[11] Patent Number: 4,492,495

[45] Date of Patent: Jan. 8, 1985

[54] ROOF SUPPORT FOR USE IN MINES

[75] Inventors: Dennis F. Rutherford; Keith D. Blackmore, both of Cheltenham, England

[73] Assignee: Dowty Mining Equipment Limited, Great Britain

[21] Appl. No.: 503,849

[22] Filed: Jun. 13, 1983

[30] Foreign Application Priority Data

Jul. 9, 1982 [GB] United Kingdom ..... 8219955

[51] Int. Cl.[3] ..... E21D 17/02

[52] U.S. Cl. ..... 405/294; 405/293

[58] Field of Search ..... 405/291-299; 299/31, 33; 91/170 MP

[56] References Cited

U.S. PATENT DOCUMENTS

| | | | |
|---|---|---|---|
| 3,240,021 | 3/1966 | Meriaux et al. | 405/294 |
| 3,686,874 | 8/1972 | Bell | 405/293 |
| 3,745,772 | 7/1973 | Welzel et al. | 248/357 X |
| 4,020,640 | 5/1977 | Sigott et al. | 405/295 |

FOREIGN PATENT DOCUMENTS

| | | | |
|---|---|---|---|
| 1329039 | 4/1963 | France | 405/294 |
| 949380 | 2/1964 | United Kingdom . | |
| 981568 | 1/1965 | United Kingdom . | |
| 1008996 | 11/1965 | United Kingdom . | |
| 1056317 | 1/1967 | United Kingdom . | |
| 1175673 | 12/1969 | United Kingdom . | |
| 1312386 | 11/1971 | United Kingdom . | |
| 2082236 | 3/1982 | United Kingdom . | |

*Primary Examiner*—Dennis L. Taylor

*Attorney, Agent, or Firm*—Hayes, Davis & Soloway

[57] ABSTRACT

A mine roof support includes a roof-engageable beam which comprises a main portion and a further portion which forms an extension of the main portion. The further portion is hinged to the main portion by a pinless knuckle joint. The further portion includes a part which projects beyond the knuckle joint and beneath the underside of the main portion with which it is engageable to limit pivotal movement of the further portion about the joint. Retaining means provide security of connection of the further portion to the main portion. Means are provided either beneath the main portion or beneath the further portion which are operative upon the further portion for tilting it about the knuckle joint.

10 Claims, 4 Drawing Figures

ROOF SUPPORT FOR USE IN MINES

This invention relates to roof supports suitable for use in mines for mine roof support during mineral-mining operations.

Certain such roof supports include a floor-engaging structure, extendable and contractible prop means carried by the floor-engaging structure, and a roof-engageable beam, supported by the prop means, which comprises a main portion and a further portion hinged to, and forming an extension of, the main portion. The further portion is intended to extend forwardly of the roof support towards the working face of the mine and when that portion is tilted upwardly by suitable means about its hinge axis it is urged positively into engagement with the mine roof between the support and said face for adequate roof support in that area.

It is desirable with such roof supports that the further portion of the beam, when engaged with the roof, is locked solid about its hinge axis if highly loaded by the roof. In practice the hinge required to achieve this must be very strong, necessitating a substantial hinge pin and substantial hinge lugs which result in the beam components being of undesirably deep form adjacent the hinge.

The invention as claimed is intended to provide a remedy. It solves the problem of how to design a roof support having a hinged roof-engageable beam in which a said further portion of the beam can be locked about its hinge axis with respect to the main portion of the beam without the need for substantial hinge pin arrangements and deep section components.

According to this invention a mine roof support includes a roof-engageable beam which comprises a main portion, a further portion forming an extension of the main portion and hinged thereto by a pin-less knuckle joint, said further portion having a part which projects beyond said knuckle joint and beneath the underside of said main portion with which it is engageable to limit pivotal movement of said further portion about said joint, and retaining means to provide security of connection of said further portion to said main portion.

The roof support may include, either beneath said main portion or alternatively beneath said further portion, means operative on said further portion for tilting it about said joint. When disposed beneath said main portion the latter means may comprise a fluid-pressure-operable capsule which is effective upon said further portion through the intermediary of a suitable operating linkage. Preferably, said linkage comprises a rocking member which is hinged to said main portion, which is pivotally connected at one end portion to said projecting part of said further portion of the beam, and which is engaged at the other end portion thereof by said capsule. When, instead, that means is disposed beneath said further portion of the beam it may comprise prop means extending from a floor beam of the support, or from structure adjacent to that floor beam, and directly connected with, or engaging, that further portion.

By "pin-less knuckle joint" we intend a means of articulating two components in which no separate hinge pin or the like is required to be introduced to complete the joint.

The advantages offered by the invention are mainly that as a result of providing said pin-less knuckle joint and said part projecting beneath the underside of said main portion, a hinge assembly of required strength is provided within roof-engageable beam components of relatively thin section, at the same time enabling the said further portion of the beam to lock solid about the knuckle joint when loaded downwardly by the mine roof, thereby maintaining effective tip contact of said further portion with the roof under such loading.

One way of carrying out the invention is described in detail below with reference to drawings which illustrate only one specific embodiment, in which.

Figure 1:
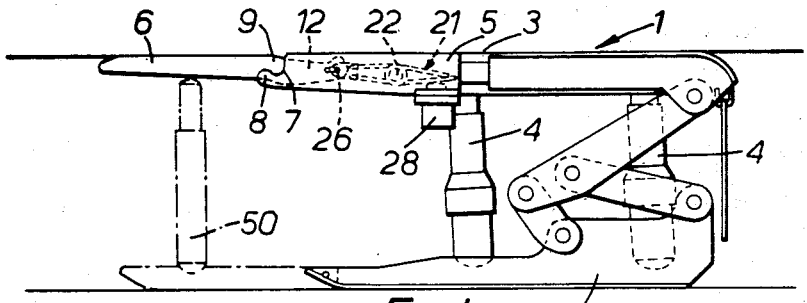
FIG. 1 is a side elevation of a roof support suitable for use in mines.

The figures show a roof support 1 which includes a floor-engaging structure in the form of a floor beam 2, a roof-engageable beam 3 and prop means in the form of four extendable and contractible hydraulically-operable props 4 which act between the floor beam and the roof-engageable beam for adjustably urging the latter into engagement with the mine roof.

The roof-engageable beam 3, or canopy, comprises a main portion 5, generally of inverted-channel shape, and a further portion 6 which effectively forms an extension of the main portion and which is hinged thereto by a pin-less knuckle joint arrangement in that no separate pin or pins are required to be introduced at the hinge axis of the joint. The arrangement of this embodiment comprises five pin-less knuckle joints 7 disposed in transversely-spaced relation as shown in FIG. 3. Each joint comprises interengaging formations 8, 9 of part-circular cross-section as shown more clearly in FIG. 2 which are co-operable with seatings 10, 11 of complementary cross-section provided, respectively, in adjacent parts of further portion 6 and main portion 5 of beam 3.

The further portion 6 has four parallel extension parts 12, 13, 14, 15 which project beyond the knuckle joints 7 rearwardly of the support and beneath the underside of the main portion 5. These parts are slotted at 16, 17, 18, 19 respectively and are engageable with the undersurface 20 of the main portion 5 to limit downward movement of the further portion 6 about the knuckle joints 7 and away from the mine roof.

A linkage, associated with the extension part 12, comprises a rocking member 21 which is so mounted within the inverted-channel section of the main portion 5 as to be pivotable about an axis 22. A similar rocking member 23 parallel with the rocking member 21 and also pivotable about the axis 22 is provided in association with the extension part 15.

The two portions 24, 25 at the forward ends, that is the left-hand ends in the drawings, of the rocking members 21, 23 are respectively received by the slots 16, 19 of the associated extension parts 12, 15 and are coupled to those parts by respective pin-and-slot connections 26, 27.

Two hydraulically-operable capsules 28, 29 are provided on the underside of the main portion 5 of beam 3 rearwardly of the common axis 22 of the rocking members 21, 23. These capsules respectively engage with the rearward ends 30, 31 of their respective rocking members 21, 23 so that as the capsules are caused to extend under fluid pressure applied to them the rocking members move in the anti-clockwise direction as viewed in FIG. 2 about their common axis 22 causing the connections 26, 27 to move downwardly and thus the further portion 6 of the beam 3 to move in the clockwise direction, as also viewed in FIG. 2, about the pin-less knuckle joints 7, so that this portion is tilted upwardly into engagement with the mine roof.

During such movement the rocking members 21, 23 serve as retaining means to resist dislocation of the knuckle joints 7 under sudden and heavy loading on the further portion 6 of the beam 3 which might otherwise cause detachment of that portion consequent upon the use of such a pin-less joint arrangement.

The two remaining and inner extension parts 13, 14 are pivotally-connected at 32, 33 to respective links 34, 35 which each have a screw-threaded and thus adjustable connection 36, 37 with a member 38, 39 of U-shape. The connections 36, 37 are such as to permit a degree of freedom of relative movement between each link 34, 35 and its member 38, 39. The two limbs of both members 38, 39 are suitably pivotally-connected to the main portion 5 of beam 3 about a common axis 40 which is disposed transversely with respect to the longitudinal axis 41 of the beam.

Figure 2:
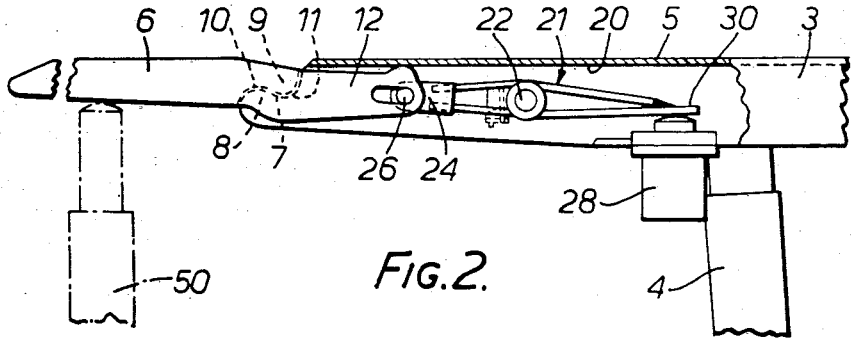
FIG. 2 is an enlarged partly cut-away side elevation of part of the roof-engageable beam or canopy of the support shown in FIG. 1.
Figure 3:
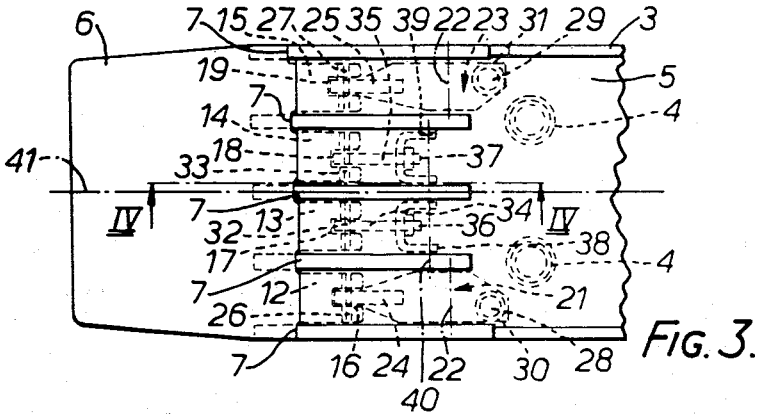
FIG. 3 is a plan view on a reduced scale of the part of the beam shown in FIG. 2, and, FIG. 4 is an enlarged sectional view taken along the line IV—IV in FIG. 3.
Figure 4:
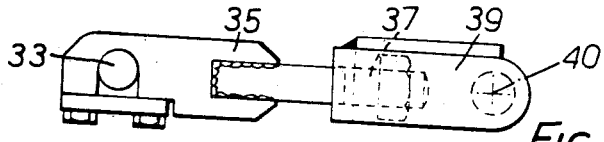

The multiple pin-less knuckle joint arrangement 7, and its associated extension parts which are engageable with the undersurface 20 of the beam when the further portion 6 of the beam is as shown in FIGS. 1 and 2 generally in alignment with the main portion 5 of the beam, withstand high roof loading within a beam cross-sectional depth which is considerably less than hitherto was the case in articulated beam constructions employing conventional hinge pins where relatively deep sections were necessary to obtain the required strength to resist the high roof loadings likely to be experienced in mineral-mining operations.

With the pin-less knuckle construction of this invention it is desirable not only to include retaining means which in the embodiment described with reference to the drawings are provided by the rocking members through the intermediary of which the capsules 28, 29 effect tilting of the portion 6, but also to include further means to protect against dislocation of the knuckle joints under whatever lateral loadings are applied to the portion 6 particularly when that portion is not loaded against the mine roof. The links 34, 35 and members 38, 39 are designed to provide such further protection because if there is any tendency to such dislocation of the knuckle joints 7 under lateral loading this is restrained by these links and members, although in affording such restraint they are themselves able to swing about the axis 40. However, the links and members are so designed that after such disturbance the joints can readily be guided back into place.

Thus by this construction we provide an adequate, reliable and compact knuckle joint arrangement for receiving the large vertical loadings and for restraining the smaller lateral loadings. By separating the restraining means for the lateral loadings the geometry of the hinges carrying the vertical loadings is not unnecessarily complicated and the linkages for restraining lateral loadings are conveniently accommodated without adding further to the depth of the roof-engageable beam. Thin roof beam sections are advantageous particularly where the roof support is used in thin seam mines, bearing in mind the requirements for travelling way along the working face in such thin seam mines.

Further, the construction is such that the retaining means for the further portion 6 of beam 3 are advantageously disposed away from the knuckle joints themselves thus avoiding mechanical complexity at the joints.

Also, the use of the parts projecting rearwardly from the further portion 6 and engageable with the undersurface 20 ensures that the beam 3 can be so locked when loaded that the forward tip of portion 6 cannot fall below the straight line projection of the main portion 5 of the beam. By so projecting rearwardly in this way these parts conveniently serve for connection with the retaining means.

In an alternative embodiment of the invention instead of providing the capsules 28, 29, prop means such as shown in dotted detail at 50 in FIGS. 1 and 2 may be provided which engage, or connect, directly with the further portion 6 of beam 3 and which are suitably supported from the floor beam 2 or from other adjacent floor-engaging structure. In this case the rocking members 21, 23 remain as retaining means or, alternatively, the rocking members are omitted and retention of the further portion 6 can be effected solely by the links 34, 35 and members 38, 39.

Further, instead of providing capsules 28, 29 in the positions shown in the drawings, alternative capsules may instead be provided in association with the rearwardly projecting parts of the further portion 6. In this case the cylinder portions of the capsules are secured to the underside of those parts and the plungers thereof project upwardly into engagement with the undersurface 20 of the main portion 5 of beam 3. With this arrangement extension of the capsules effects tilting of the further portion 6 of the beam about the knuckle joint arrangement 7 towards the mine roof.

Although in the embodiment above described with reference to the drawings there are five knuckle joints giving desired load-carrying capability, in other embodiments any other suitable number of such knuckle joints may be provided.

The invention is not limited to the form of links and rocking members above described with reference to the drawings, as in other embodiments links and members of suitable alternative form may instead be used.

We claim:

1. A mine roof support including a roof-engageable beam which comprises a main portion, a further portion forming an extension of the main portion and hinged thereto by a pin-less knuckle joint, said further portion having a rear part which projects beyond said knuckle joint and beneath the underside of said main portion with which the rear part is engageable to limit pivotal movement of said further portion about said joint, and retaining means to provide security of connection of said further portion to said main portion a said retaining means being pivotally connected to the rear part of the extension and pivotally connected to the main portion, the pivotal connections permitting movement of the rear part vertically but preventing lateral movement of said rear part.

2. A support as claimed in claim 1, in which means is operative on said further portion for tilting it about said joint.

3. A support as claimed in claim 2, in which said means operative on said further portion is disposed beneath said main portion.

4. A support as claimed in claim 3, in which said means operative on said further portion comprises a fluid-pressure-operable capsule which is effective upon said further portion through the intermediary of an operating linkage.

5. A mine roof support including a roof-engageable beam which comprises a main portion, a further portion forming an extension of the main portion and hinged thereto by a pin-less knuckle joint, said further portion having a rear part which projects beyond said knuckle joint and beneath the underside of said main portion with which the rear part is engageable to limit pivotal movement of said further portion about said joint, and retaining means to provide security of connection of said further portion to said main portion, means operative on said further portion for tilting it about said joint and being disposed beneath said main portion, said operative means comprising a fluid-pressure-operable capsule which is effective upon said further portion through the intermediary of an operating linkage, said operating linkage comprising a rocking member which is hinged to said main portion, which is pivotally-connected at one end portion to the projecting part of said further portion and which is engaged at the other end portion thereof by said capsule.

6. A support as claimed in claim 2, in which said means operative on said further portion is disposed beneath said further portion.

7. A support as claimed in claim 6, in which said means operative on said further portion comprises prop means extending from a floor beam of the support and directly engaging said further portion.

8. A support as claimed in claim 1, in which said further portion is hinged to said main portion by a plurality of said pin-less knuckle joints spaced one from another transversely of said beam.

9. A support as claimed in claim 8, in which each said pin-less knuckle joint comprises interengaging formations of part-circular cross-section, which are co-operable with seatings of complementary cross-section, provided respectively in adjacent parts of said further portion and said main portion.

10. A support as claimed in claim 8, in which said further portion comprises a plurality of projecting parts which extend in parallel manner beyond said knuckle joints and beneath the underside of said main portion.

* * * * *